US012473063B2

(12) United States Patent
Berger

(10) Patent No.: US 12,473,063 B2
(45) Date of Patent: Nov. 18, 2025

(54) DEVICE FOR CONNECTION BETWEEN A CANVAS AND A RAIL

(71) Applicant: Pierre Berger, La Mole (FR)

(72) Inventor: Pierre Berger, La Mole (FR)

( * ) Notice: Subject to any disclaimer, the term of this patent is extended or adjusted under 35 U.S.C. 154(b) by 434 days.

(21) Appl. No.: 18/027,510

(22) PCT Filed: Sep. 4, 2021

(86) PCT No.: PCT/FR2021/000102
§ 371 (c)(1),
(2) Date: Mar. 21, 2023

(87) PCT Pub. No.: WO2022/064108
PCT Pub. Date: Mar. 31, 2022

(65) Prior Publication Data

US 2023/0373605 A1 Nov. 23, 2023

(30) Foreign Application Priority Data

Sep. 23, 2020 (FR) ..... 2009673

(51) Int. Cl.
*B63H 9/08* (2006.01)

(52) U.S. Cl.
CPC ..... *B63H 9/08* (2013.01)

(58) Field of Classification Search
CPC ..... B63H 9/08; B63B 17/02
See application file for complete search history.

(56) References Cited

U.S. PATENT DOCUMENTS 5,044,294 A * 9/1991 Kronich ..... B63H 9/08 114/90
5,065,686 A 11/1991 Foster
5,540,171 A * 7/1996 Monahan ..... B63H 9/08 114/204
2014/0352593 A1 12/2014 Lowe

FOREIGN PATENT DOCUMENTS

JP 5869677 5/1983
WO 98/41446 9/1998
WO 2010/019692 2/2010

OTHER PUBLICATIONS

International Search Report for PCT/FR2021/000102 dated Jan. 3, 2022, 7 pages.
Written Opinion of the ISA for PCT/FR2021/000102 dated Jan. 3, 2022, 5 pages.

* cited by examiner

*Primary Examiner* — Stephen P Avila
(74) *Attorney, Agent, or Firm* — NIXON & VANDERHYE

(57) ABSTRACT

Disclosed are devices for connection between a canvas and a rail defining a path of direction. The device includes a part mounted to move with respect to the rail on the path; a part; a unit for securing this part with a point defining a direction; and a unit for rotatably mounting the part with respect to the part about an axis such that the part is able to take all positions between a first position and a second position, the first position being defined so that the direction makes, with the axis, a second non-zero angle and the position being defined so that the direction is parallel to the longitudinal axis.

20 Claims, 2 Drawing Sheets

[Fig. 1]
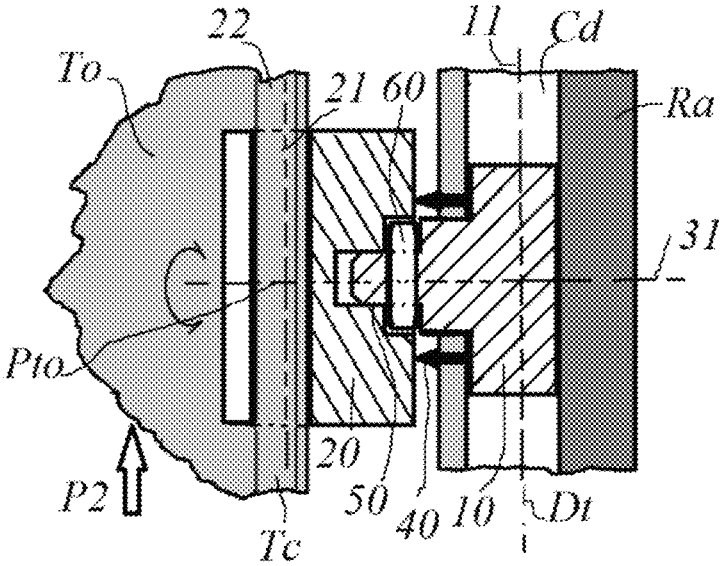
[Fig. 2]
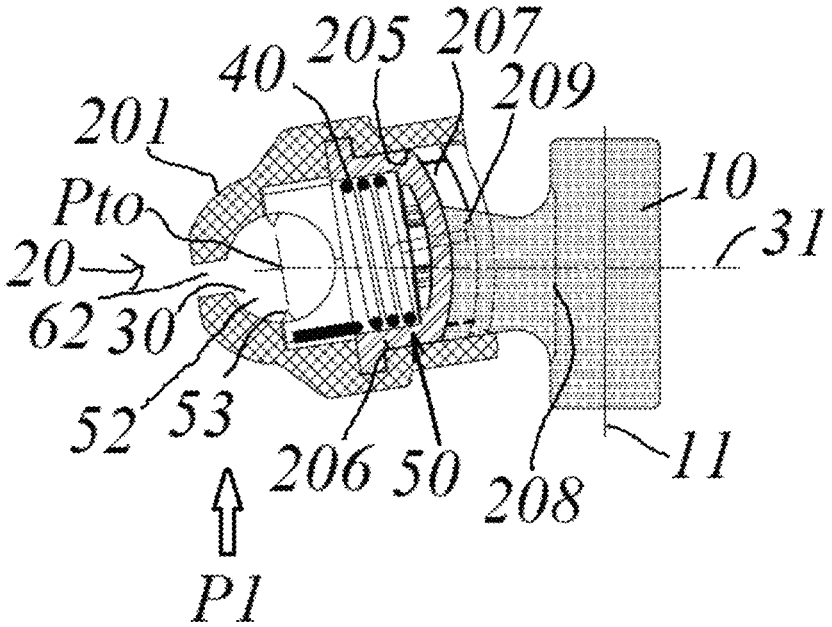

[Fig. 3]
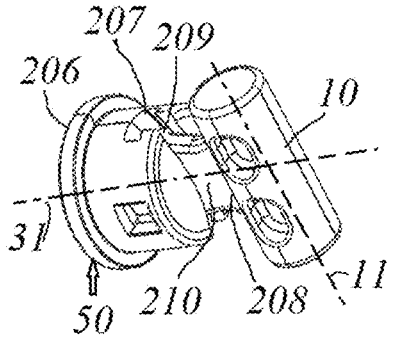
[Fig. 4]
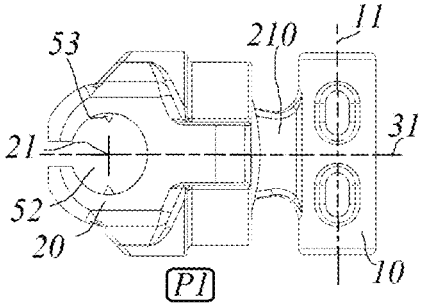
[Fig. 5]
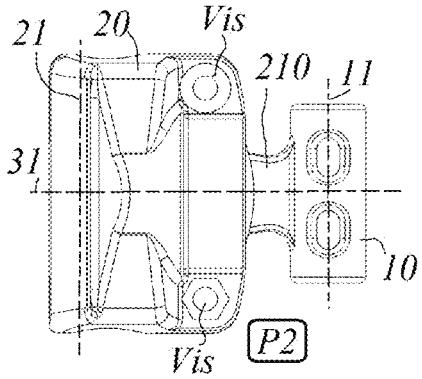
[Fig. 6]
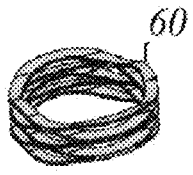

DEVICE FOR CONNECTION BETWEEN A CANVAS AND A RAIL

CROSS-REFERENCE TO RELATED APPLICATIONS

This application is the U.S. national phase of International Application No. PCT/FR2021/000102 filed Sep. 4, 2021 which designated the U.S. and claims priority to French Patent Application No. 2009673 filed Sep. 23, 2020, the entire contents of each of which are hereby incorporated by reference.

BACKGROUND OF THE INVENTION

Field of the Invention

The present invention relates to device for connection between a canvas and a rail, which has a particularly advantageous application when the canvas is constituted by one of the following elements: a blackout curtain, for example for a window, capable of being associated with a curtain rod or in a place to be protected, like in a hospital environment; a boat sail capable of being associated with a boat sail mast, etc.

Description of the Related Art

In the cases mentioned above, the canvas is capable of taking two extreme positions corresponding respectively to a state in which it is folded. For example, for a canvas constituted of a boat sail, these two positions are defined, by persons skilled in the art, by the following terms: "mounted sail" and "flaked sail". The latter position is that which precedes the storage of the sail according to different processes, or its rise.

The processes for storing a boat sail are functions of numerous parameters: the size of the sail, the place, the environmental conditions, the weather conditions, and pose problems onboard boats, in particular by bad weather.

Indeed, it is observed that the usual systems for connecting the sails to the masts do not make it possible to flake the sails in a correct folding, without a manual intervention, if only to be able to store them directly in a "sail bag" or similar.

These systems are very schematically constituted of a part for fastening to the mast, of another part for fastening to the sail and a flexible link connecting these two parts. Such a system is, for example, described in U.S. Pat. No. 5,065,686, but this system does not enable a folding of the sail correctly, in particular symmetrically and with a lesser thickness to facilitate its storage, for example in a bag or similar.

The problem exposed above for the storage of the boat sails is posed in the same way for canvas curtains or similar, associated with the openings of a room, windows or doors. A curtain can, itself also, be in the unfolded position (closed curtain) or in the folded position (open curtain), and it is preferable that it is folded as best as possible, for example concertinaed, if only for aesthetic reasons.

SUMMARY OF THE INVENTION

Also, the present invention has the aim of proposing a device for connection between a canvas and a rail, which makes it possible to perform a correct and automatic folding during, for example, the flaking of a boat sail or the opening of a curtain.

More specifically, the present invention aims for a device for connection between a canvas and a rail.

BRIEF DESCRIPTION OF THE DRAWINGS

Other features and advantages of the present invention will appear during the following description, given regarding the illustrative accompanying drawings, but in a not-at-all limiting manner, wherein:

FIG. 1 represents a cross-sectional view of a principle diagram of the device for connection according to the invention between a canvas and a rail, FIG. 2 represents a cross-sectional view of an industrial implementation of the device according to the invention, in accordance with the illustration according to FIG. 1, FIG. 3 represents, in cavalier perspective, a part of the device according to the invention in accordance with the implementation illustrated in FIG. 2, FIG. 4 represents a side view of the device according to the invention in accordance with the same implementation, in a possible so-called "rest" configuration, FIG. 5 represents a view of the same side as for FIG. 4, of the device according to the invention in accordance with the same implementation, but in another possible so-called "active" configuration, FIG. 6 represents, in cavalier perspective, an implementation of an element constituting the device according to the invention, namely a damping means.

DESCRIPTION OF THE PREFERRED EMBODIMENTS

It is first specified that, in the figures, the same references designate the same elements, whatever the figure in which they appear and whatever the form of representation of these elements.

Likewise, if elements are not specifically referenced in one of the figures, their references can be easily found by referring to another figure.

It is also specified that FIGS. 2-6 represent an industrial implementation of the subject matter according to the invention, but there can be other implementations which meet the definition of this invention.

FIG. 1 is a principle diagram of the subject matter of the invention, which relates to a device for connection between a canvas To and a rail Ra in which a movement path Cd in a translation direction Dt is achieved.

This movement path can be constituted in different ways, for example of a groove or laterally opening-out open channel made in an upright forming a rail. By canvas, it is mainly, but not exclusively understood, as a boat sail or a blackout curtain of any type for a room opening, a window or a door or similar as specified above.

The device is capable of translating, substantially parallel to the translation direction Dt, at least one point Pto of the canvas To.

This device comprises a first part 10 defining a longitudinal axis 11. This first part 10 is advantageously cylindrical, optionally of revolution, when the movement path Cd in the translation direction Dt is constituted by a channel or similar, such that this first part 10 can be moved by sliding in this channel.

It is however specified that this movement path with channel is a preferable implementation, but that another implementation can be provided where the movement path is a cable or similar along which will be capable of moving the first part 10.

This first part is therefore capable of being mounted movably engaged with the rail Ra on the movement path Cd in the translation direction Dt, such that the longitudinal axis 11 is substantially parallel to this translation direction Dt.

The device comprises a second part 20 and means 30 (FIG. 2), called "first means", for securing this second part 20 to the point Pto on a substantially straight segment 21 of non-zero length of the canvas To, this straight segment passing through this point defining a holding direction 22 for the canvas To.

It also comprises means 50, called "second means", for rotatably mounting the second part 20 with respect to the first part 10 about at least one axis of rotation 31 forming with the longitudinal axis 11, a first angle of non-zero value and such that the second part 20 is capable of taking all positions between a first position P1 and a second position P2.

The first position P1 (FIGS. 2 and 4) is defined such that the holding direction 22 for the canvas forms, with the longitudinal axis 11, an angle of non-zero value, called "second angle".

As regards the second position P2 (FIGS. 1 and 5), it is defined such that the holding direction 22 for the canvas To is substantially parallel to the longitudinal axis 11.

The "first means" for securing the second part 20 to the point Pto on a substantially straight segment 21 of non-zero length of the canvas, can be achieved in numerous ways. In the case of a boat sail, these first means are advantageously constituted, for example, of a semi-rigid cylindrical rod Tc, of the so-called "blackjack" type or similar, which is securely connected to the edge of the sail, and of a cylindrical recess 52 made in the second part 20 and partially laterally open to let the sail pass through when the rod TC is in the recess 52, FIGS. 1, 2, 4.

In this recess 52, the length of which is equal to the length of the straight segment 21 on which the canvas To must be held, the semi-rigid cylindrical rod is housed, and the latter is held there by studs 53 which can penetrate and be anchored in the rod Tc such that this rod does not slide into the recess 52 and that it is secured to the second part 20. The association of the sail with this second part 20 is facilitated by a particular implementation of the latter which will be described below, in particular its implementation in two parts capable of being secured to one another for its formation.

According to a very preferable feature of the invention, the device further comprises resilient constraint means called "third means" mounted engaged between the first part 10 and the second part 20, schematically illustrated in FIG. 1 and according to an industrial implementation in FIG. 2, so as to tend to return the second part into its first position P1 when it has been constrained to take a position different from this first position under the effect of an external constraint force.

According to an advantageous implementation, these third means are constituted by a spring 40, an end of which is secured to one of the first and second parts 10, 20 and the other end secured to the other part 20, 10. This spring 40 is mounted such that it is not constrained when the second part 20 is in its first position P1 and constrained (or, according to the usual expression, "flexed") when the second part 20 is in its second position P2.

This spring 40 is advantageously constituted by a double twist spring for manufacturing reasons. A double twist spring is constituted of turns wound in a double helix, advantageously with contiguous turns. It enables a rotating part to return to its original position, as soon as there is no longer force. Its advantage, with respect to the single twist spring, is constituted by the fact that it is easier to guide, and in particular, that it can be returned to act in right-hand and left-hand rotations between the two parts 10 and 20.

According to a preferred implementation, the first angle of non-zero value is at most equal, and even preferably equal, to ninety degrees, as well as the second angle of non-zero value.

According to another advantageous implementation of the device, the second means for rotatably mounting the second part 20 with respect to the first part 10 are constituted by a ball 50 at at least two degrees of freedom, a degree about the axis of rotation 31 defined above and another, in a direction perpendicular to this axis 31. Such a ball 50, as illustrated in FIGS. 2 and 3, is mainly constituted by a cylindrical housing of revolution 205 made in the second part 20, by a ball head 206 rotatably mounted and retained in the cylindrical housing of revolution 205, this ball head 206 comprising a female part 207 for a nesting sliding substantially linearly in a direction forming a non-zero angle with respect to the axis of rotation 31, this female part 207 being constituted, in a manner known in itself, by an open trench bordered by a retaining shoulder.

As regards the male part 209 of the sliding nesting, it is constituted by a first end 209 of a tab 210, the second end 208 of which is secured to the first part 10, the first end 209 of this tab 210 being mounted engaged by sliding into the female part 207.

Preferably, the device further comprises damping means 60 interposed between the first part 10 and the second part 20 (illustrated schematically in FIG. 1), in particular in its application to boat sails. Such damping means are advantageously constituted by a so-called SMALLEY® flat-thread compression wave spring, FIG. 6, this wave spring being disposed substantially coaxially to the axis of rotation 31.

Advantageously, the second part 20 is made of at least two parts 201, 202, which could be assembled and secured to one another by any means, clipping, screwing (Vis—FIG. 5), strapping, etc., to facilitate the mounting between this second part and the first part 10 and its association with the edge of the sail as explained above. A using and operating mode for the device, a possible embodiment of which has been described above, are as follows, by specifying that their description will be given, more specifically in the case of an application to a boat sail.

It is assumed that there is, available to the user of the boat, a determined quantity of devices according to the invention.

These devices are grouped together in two different assemblies, each assembly comprising a substantially equal number, for example, of devices to one unit. These two assemblies each comprising devices, the positions P2 of the second part 20 of which with respect to the first part 10 are obtained respectively by rotations in opposite directions, namely right-hand and left-hand rotations.

Thus, to facilitate the following summary, the devices of an assembly will be qualified as "right-hand devices", and the devices of the other assembly, as "left-hand devices".

The user of the boat first installs, on the mast of a sail of their boat, alternatively left-hand devices and right-hand devices, by their first part 10. The first parts 10 are slid, for example, into a groove of the mast (as illustrated in FIG. 1), which is the most common implementation.

Then, it associates the edge of this sail, that which must border the mast, to the second part of each device, for example as described above, in points Pto of the edge of the sail separated from one another, for example by one same determined distance at the desire of the boatsman.

For example, this distance is chosen such that, when the sail is flaked, its bulk width is equal to a value 2X, for example to enable to store it in a bag of a width of at least 2X. In this case, this distance will be chosen equal to 2X.

In this configuration, the sail is flaked and the second parts 20 of all the devices are in the configuration P1, namely "non-constrained spring 40". The sail is therefore folded concertinaed and has opposite folds, each of a depth equal to X.

To navigate, the user will, according to the well-known expression, mount the sail, by pulling in its summit from, for example, the top of the mast, via a hoist or similar, of the manual or electric type.

Under the action of this traction force, the sail will unfold and, while unfolding, make both the first parts 10 of the devices slide along the mast in the groove and make the second parts 20 pass into the second position P2 against the springs 40 (FIGS. 1 and 5), i.e. that which constrains the springs and therefore, that where the straight segments 21 are substantially parallel to the direction 11, FIG. 5. With the sail mounted, the user can navigate as they do usually.

When they no longer want to use this sail, it flakes. The springs 40, released from the traction exerted by the mounted sail, will automatically return to their rest state, i.e. non-constrained, and make all the second parts 20 return into their configuration P1, rotating alternatively in the left-hand and right-hand directions according to the example taken for this description of operation and use.

This has the effect of folding the sail fully concertinaed according to a width, overall equal to 2X, all the folds being opposite one another and of identical depth, automatically without additional handling.

The using mode described above is only an example given as an illustration, other modes are possible.

The use and the operation of the device according to the invention in its application to a curtain of any type, are easily deduced mutatis-mutandis from the embodiment described above. Certain terms must simply be changed: sail with curtain, mast with rod, mounted sail with closed or pulled curtain, flaked sail with open curtain, stored sail with curtain retracted on one of the sides of the opening (or similar) to release it. In the light of the structural and operational descriptions, made above, it is clear that the aims of the invention are well achieved, with devices according to the invention which are further a very simple structure, more expensive and which are highly satisfactory, in particular, to sailboat users.

The invention claimed is:

1. Device for connection between a canvas and a rail, wherein a movement path in a translation direction is achieved, said device being capable of translating, substantially parallel to the translation direction, at least one point of this canvas, comprising:

a first part defining a longitudinal axis and capable of being mounted engaged moving with the rail on said movement path in said translation direction, such that said longitudinal axis is substantially parallel to said translation direction, a second part, means, called "first means", for securing this said second part to the point on a substantially straight segment of non-zero length, this said straight segment passing through this said point defining a holding direction for the canvas, and means, called "second means", for rotatably mounting said second part with respect to the first part about at least one axis of rotation, said axis of rotation forming with the longitudinal axis, a first angle of non-zero value, such that said second part is capable of taking all positions between a first position and a second position, the first position being defined such that the holding direction for the canvas makes, with the longitudinal axis, a second angle of non-zero value, and the second position being defined such that said holding direction for the canvas is substantially parallel to the longitudinal axis, resilient constraint means called "third means", mounted engaged between the first part and the second part so as to tend to return said second part into the first position when said second part has been constrained to take a position different from this first position under the effect of an external constraint force.

2. The device according to claim 1, wherein said third means are constituted by a spring, an end of which is secured to one of the first and second parts and the other end secured to the other part, this said spring being mounted such that the spring is not constrained when the second part is in its the first position and constrained when said second part is in the second position.

3. The device according to claim 2, wherein said spring is a double twist spring.

4. The device according to claim 1, wherein said first angle of non-zero value is at most equal to ninety degrees and that said second angle of non-zero value is substantially equal to ninety degrees.

5. The device according to claim 1, wherein the second means for rotatably mounting the second part with respect to the first part are constituted by a ball at at least two degrees of freedom.

6. The device according to claim 5, wherein said ball with two degrees of freedom is constituted by:

a cylindrical housing of revolution made in said second part, a ball head rotatably mounted retained in said cylindrical housing of revolution, said ball head comprising a female part of a nesting sliding substantially linearly in a direction forming a non-zero angle with respect to the axis of rotation, said nesting being constituted of two parts, respectively said female part and a male part, the male part of the nesting being constituted by a first end of a tab, the second end of which is secured to said first part, the first end shaped in the male part being mounted engaged by sliding with the female part of said nesting.

7. The device according to claim 1, wherein said canvas is constituted by one of the two following elements:

a blackout curtain capable of being associated with a curtain rod, a boat sail capable of being associated with a sailboat mast.

8. The device according to claim 1, further comprising damping means interposed between the first part and the second part.

9. The device according to claim 1, wherein said first part is substantially cylindrical of revolution.

10. The device according to claim 2, wherein said first angle of non-zero value is at most equal to ninety degrees and that said second angle of non-zero value is substantially equal to ninety degrees.

11. The device according to claim 3, wherein said first angle of non-zero value is at most equal to ninety degrees and that said second angle of non-zero value is substantially equal to ninety degrees.

12. The device according to claim 2, wherein the second means for rotatably mounting the second part with respect to the first part are constituted by a ball at at least two degrees of freedom.

13. The device according to claim 3, wherein the second means for rotatably mounting the second part with respect to the first part are constituted by a ball at at least two degrees of freedom.

14. The device according to claim 4, wherein the second means for rotatably mounting the second part with respect to the first part are constituted by a ball at at least two degrees of freedom.

15. The device according to claim 2, wherein said canvas is constituted by one of the two following elements:

a blackout curtain capable of being associated with a curtain rod, a boat sail capable of being associated with a sailboat mast.

16. The device according to claim 3, wherein said canvas is constituted by one of the two following elements:

a blackout curtain capable of being associated with a curtain rod, a boat sail capable of being associated with a sailboat mast.

17. The device according to claim 4, wherein said canvas is constituted by one of the two following elements:

a blackout curtain capable of being associated with a curtain rod, a boat sail capable of being associated with a sailboat mast.

18. The device according to claim 5, wherein said canvas is constituted by one of the two following elements:

a blackout curtain capable of being associated with a curtain rod, a boat sail capable of being associated with a sailboat mast.

19. The device according to claim 6, wherein said canvas is constituted by one of the two following elements:

a blackout curtain capable of being associated with a curtain rod, a boat sail capable of being associated with a sailboat mast.

20. The device according to claim 2, further comprising damping means interposed between the first part and the second part.

* * * * *